United States Patent [19]

Khirwadkar

[11] Patent Number: 4,565,291

[45] Date of Patent: Jan. 21, 1986

[54] HYDRAULIC LIFTING ASSEMBLY FOR MOUNTING A CRANE JIB

[76] Inventor: Prabhakar R. Khirwadkar, Siechenreuteweg 20, 8940 Memmingen, Fed. Rep. of Germany

[21] Appl. No.: 489,144

[22] Filed: Apr. 27, 1983

[30] Foreign Application Priority Data

Apr. 27, 1982 [DE] Fed. Rep. of Germany ..... 3215635

[51] Int. Cl.[4] ..... B66C 23/36

[52] U.S. Cl. ..... 212/180; 212/182; 212/261

[58] Field of Search ..... 212/175, 176, 179–182, 212/187, 189, 194, 261

[56] References Cited

U.S. PATENT DOCUMENTS

| | | | |
|---|---|---|---|
| 2,941,674 | 6/1960 | Bille | 212/194 |
| 3,174,630 | 3/1965 | Tantlinger et al. | 212/189 |
| 3,603,464 | 9/1971 | Teodorescu | 212/189 |
| 4,019,642 | 4/1977 | Hammar | 212/189 |

FOREIGN PATENT DOCUMENTS

| | | | |
|---|---|---|---|
| 2833535 | 2/1980 | Fed. Rep. of Germany | 212/180 |
| 157250 | 7/1978 | Netherlands | 212/261 |
| 586109 | 12/1977 | U.S.S.R. | 212/261 |
| 640963 | 1/1979 | U.S.S.R. | 212/261 |

*Primary Examiner*—Trygve M. Blix
*Assistant Examiner*—Stephen P. Avila
*Attorney, Agent, or Firm*—Lackenbach Siegel Marzullo Presta & Aronson

[57] ABSTRACT

The hydraulic lifting provision for the mounting of a crane jib comprises two lift provisions disposed successively at a distance, where each lift provision comprises two base frames rising up from the trailer and disposed at a distance from each other and in each case a tiltable lift arm is disposed at the free end. The free ends of the lift arms are in each case hingedly connected via a cross-frame, where the support for the crane jib is disposed in each case on the cross frame. The cross frames with the supports disposed thereon are tiltable to the side by way of a different operating action of the hydraulic cylinders engaging them. In addition, the supports are constructed shiftable to the sides along the cross-frames by way of a corresponding disposition of additional hydraulic cylinders.

8 Claims, 5 Drawing Figures

HYDRAULIC LIFTING ASSEMBLY FOR MOUNTING A CRANE JIB

BACKGROUND OF THE INVENTION

1. Field of the Invention

The invention relates to a hydraulic lifting assembly for mounting a crane jib from a transport vehicle.

2. Description of the Related Art

Since vehicle cranes become heavier and heavier based on higher load capacities, a crane jib with a capacity of about 47 tons has to be demounted for transport on roads. In order to reduce the time for the mounting or demounting of a crane jib for a vehicular crane at a construction site, it is advantageous for the mounting of the crane jib to be performed directly from the jib transporting vehicle.

SUMMARY OF THE INVENTION

Therefore, an object of the invention is to provide a hydraulic lifting assembly for the mounting of a crane jib such that a short mounting time is achieved. A hydraulic lifting assembly in accordance with the invention permits the jib to be shifted vertically, horizontally by turning or, respectively, at an inclined plane, by way of two lifting provisions such that a simple mounting from a transport vehicle is possible. The operation of the hydraulic apparatus is provided via a side drive with a hydraulic pump from the transport vehicle.

Several different features of such a lifting assembly are provided according to the invention.

In accordance with one feature, the crane jib is liftable vertically, as well as slidable on its supports.

Several application situations however also require the additional feature of the invention according to which the lifting assembly cross frame with the supports provided therewith is tiltable sideways. In this way it is possible in addition to rotate the jib around its longitudinal axis.

A further feature is that the supports in addition can be moved to the sides. This makes it possible to shift the crane jib at an angle to its longitudinal axis in the horizontal plane or, alternatively, to perform a rotary motion of the crane jib in that plane by sliding the front and rear supports oppositely to each other.

Therefore, a three dimensional adjustment of a crane jib is possible on the transport vehicle by way of the proposed lift provisions such that all mounting problems are taken into consideration.

A particularly simple hinged support for the cross-frames is achieved by having the cross-frame supported hinged via pendulum arms at the free ends of the lift arms. It is important in this context that the hinged support have two degrees of freedom in order to allow for motion in side direction (motion of the cross-frame in the direction of its longitudinal axis).

Instead of using two pendulum arms, the cross-frame may be hinged via a parallelogram support.

It will be apparent that the hinged support of the cross-frame can be provided by different hinge mechanisms.

If the two lift arms of a lift provision in each case are lifted up to different height levels, then a rotation of the crane jib around its longitudinal axis results. It is preferred for that purpose that the support for the crane jib be provided by a luffing support table which is tiltably supported on a luffing support bolt directed in the longitudinal direction of the trailer, which bolt is supported by a luffing support block disposed at the cross-frame. In case of a differing lifting of the lift arms there is built in a safety provision against incompetent operation by way of an electrical stop switch.

In order to assure slidability of the supports to the sides the luffing support block is slidable via slide plates in the longitudinal direction of the cross-frame.

Advantageously such a luffing support block is provided only at a single lift provision, for example at the front lift provision, while the rear lift provision is provided with only a support table slidable to the sides.

BRIEF DESCRIPTION OF THE DRAWINGS

The invention is described in more detail with reference to the following drawings showing one embodiment of the invention and the features essential thereto, and wherein.

DESCRIPTION OF THE PREFERRED EMBODIMENTS

Figure 1:
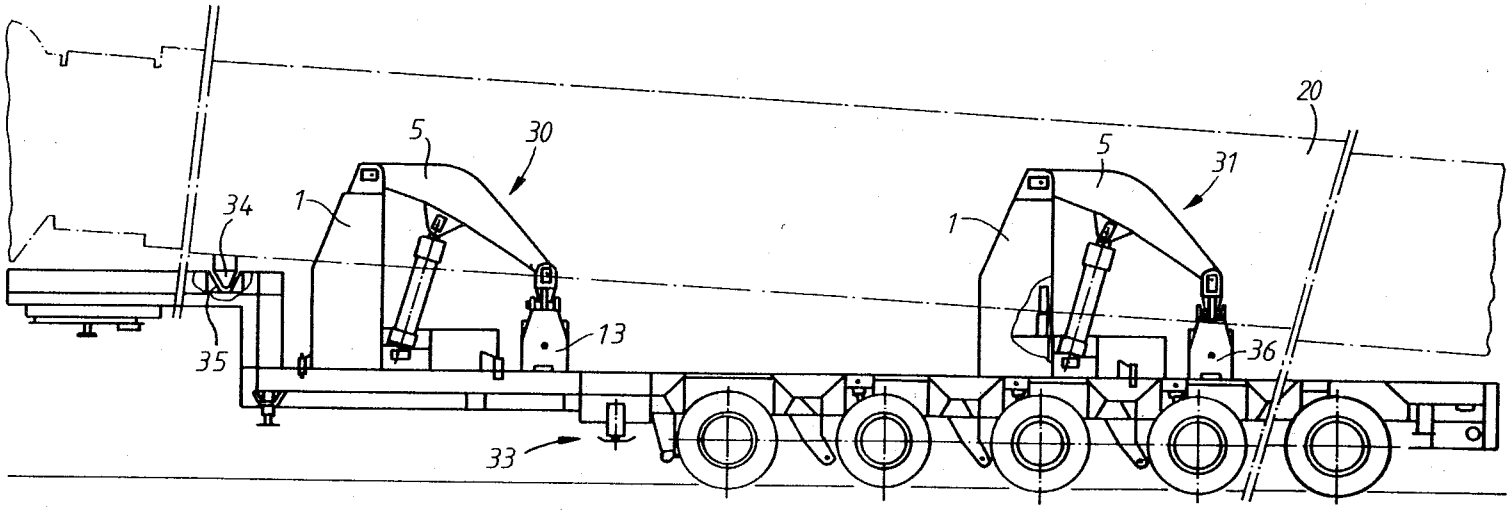
FIG. 1 is a side view of a low flat bed semitrailer with lift provisions installed on the front and rear thereof.
Figure 2:
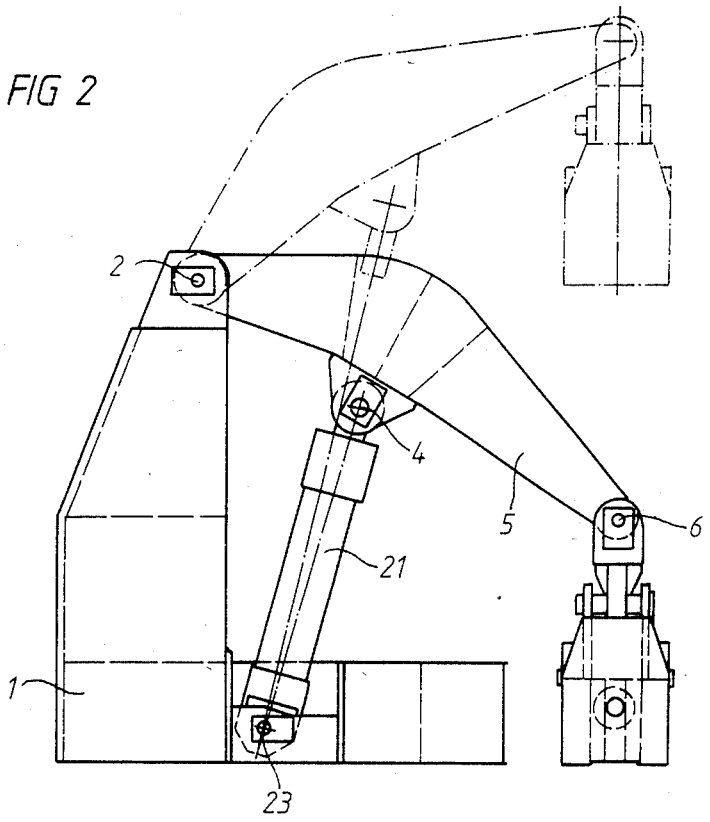
FIG. 2 is a side view of the rear lifting provision.
Figure 3:
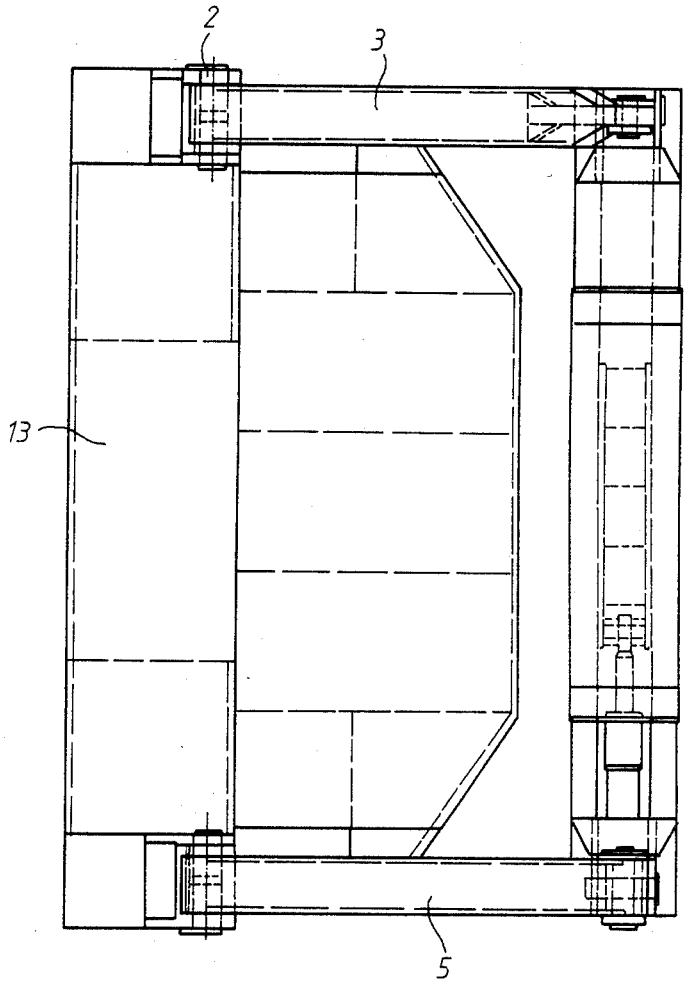
FIG. 3 is a plan view of the rear lift provision.
Figure 4:
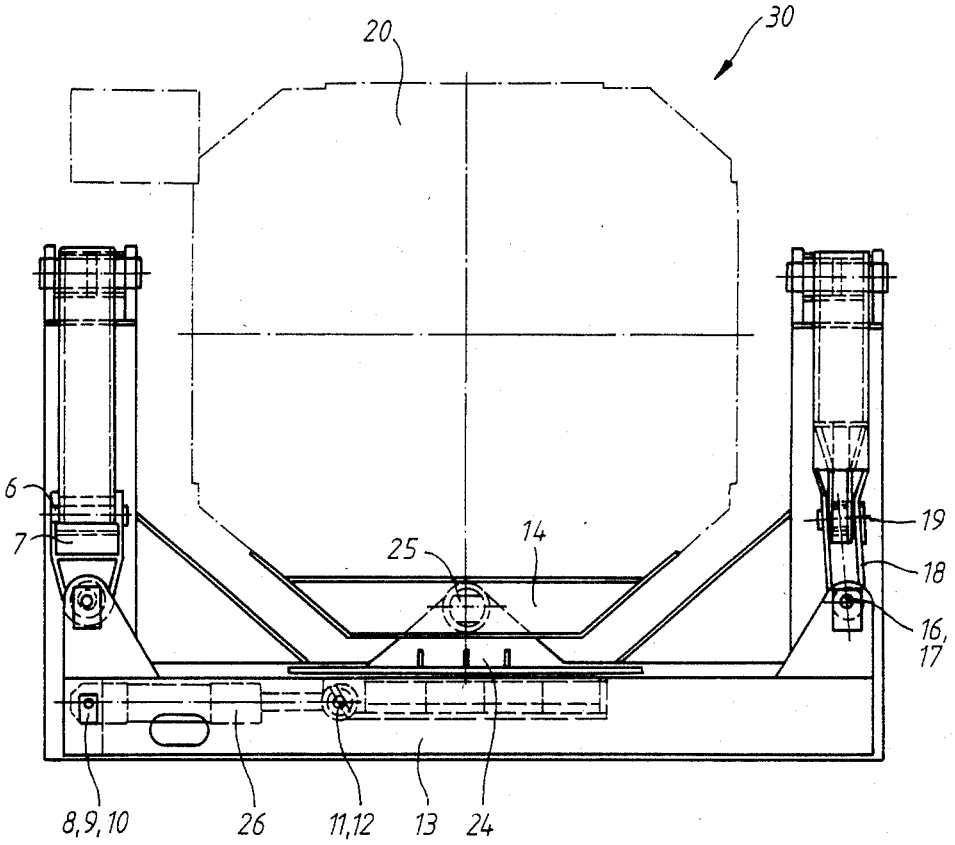
FIG. 4 is a front view of the front lift provision.

The trailer 33 is shown in FIG. 1 as a saddle low flat bed trailer, but it can also be constructed as a flat bed bridge or as a different kind of trailer. Front and rear lift provisions 30, 31 are disposed on the trailer 33 separated at a distance from each other. Each of the lift provisions 30, 31 comprises a base frame 1 attached to the trailer 33 by way of threaded bolts, and right and left lift arms 3, 5 joined to the upper end of the base frame in freely tiltable disposition. The tilting of the lift arms 3, 5 is provided by way of hydraulic cylinders, as shown in more detail in FIG. 2. The crane jib 20 shown in dash dotted lines thus can be moved in all three spacial directions, pointed on a lower centering nose 34 disposed at the bottom of the crane jib for securing the position of the crane jib 20 on the trailer 33. The centering nose engages a correspondingly formed recess 35 in the trailer 33. The trailer 33 is a low flat bed semitrailer provided with six axles with in each case a hydraulic load balancing such that the height of the trailer and its inclination with respect to the horizontal can be adjusted. Such a low flat bed semitrailer is in commercial mass production. The construction of the lift provision 30, 31 is illustrated in more detail in FIGS. 2 to 5.

A bolt 2 is disposed at a corresponding support at the upper end of the base frame 1 such that the lift arm 5 is freely tiltably disposed at this support. A support opening is disposed about at the middle of the lift arm 5 and an additional bolt 4 is disposed in the support opening. A piston rod of a hydraulic cylinder 21 connects to the bolt 4 and the other end of the hydraulic cylinder 21 is connected to the base frame 1 by way of a bolt 23. The lift arm 5 can be freely tilted with its free end (bolt 6) in a vertical plane by actuation of the hydraulic cylinder 21. A right lift arm 3 with a correspondingly coordinated hydraulic cylinder is disposed on the other side at an exactly mirror symmetric disposition with regard to the longitudinal axis of the trailer 33. The two hydraulic cylinders can be operated exactly in parallel or independently from each other such that the two free ends of the lift arms 3, 5 can be tilted within a plane as well as in separate planes.

In each lift provision a pendulum arm 7 is connected at the free end of lift arm 5, a pendulum arm 18 is connected at the free end of lift arm 3 via a bolt 19, the rotational axes of the pendulum arms 7, 18 being rotated with respect to each other by 90 degrees. In each case a screw bolt 16 and a spring washer 17 are disposed at the free end of each of the pendulum arms 17, 18 such that in this way a swinging support is formed for the cross-frame 13 attached to the support. The front lift provision 30 is provided with a luffing support block 24 slidable via slide plates in the direction of the longitudinal axis of the cross-frame 13. A luffing support bolt 25 is disposed in a corresponding hinge shell at the upper end of the luffing support block. A luffing support table 14 is tiltably supported over the luffing support bolt 25 and the luffing support table provides the load support for the crane jib 20.

The luffing support block 24 can be shifted by way of a hydraulic cylinder 26 in the direction of the longitudinal axis of the cross-frame 13, where the end of the hydraulic cylinder 26 is connected to the cross-frame 13 via bolt 8, screw bolt 9 and spring washer 10, while the piston rod is connected via bolt 11 and a screw 12 with the luffing support block 24.

Figure 5:
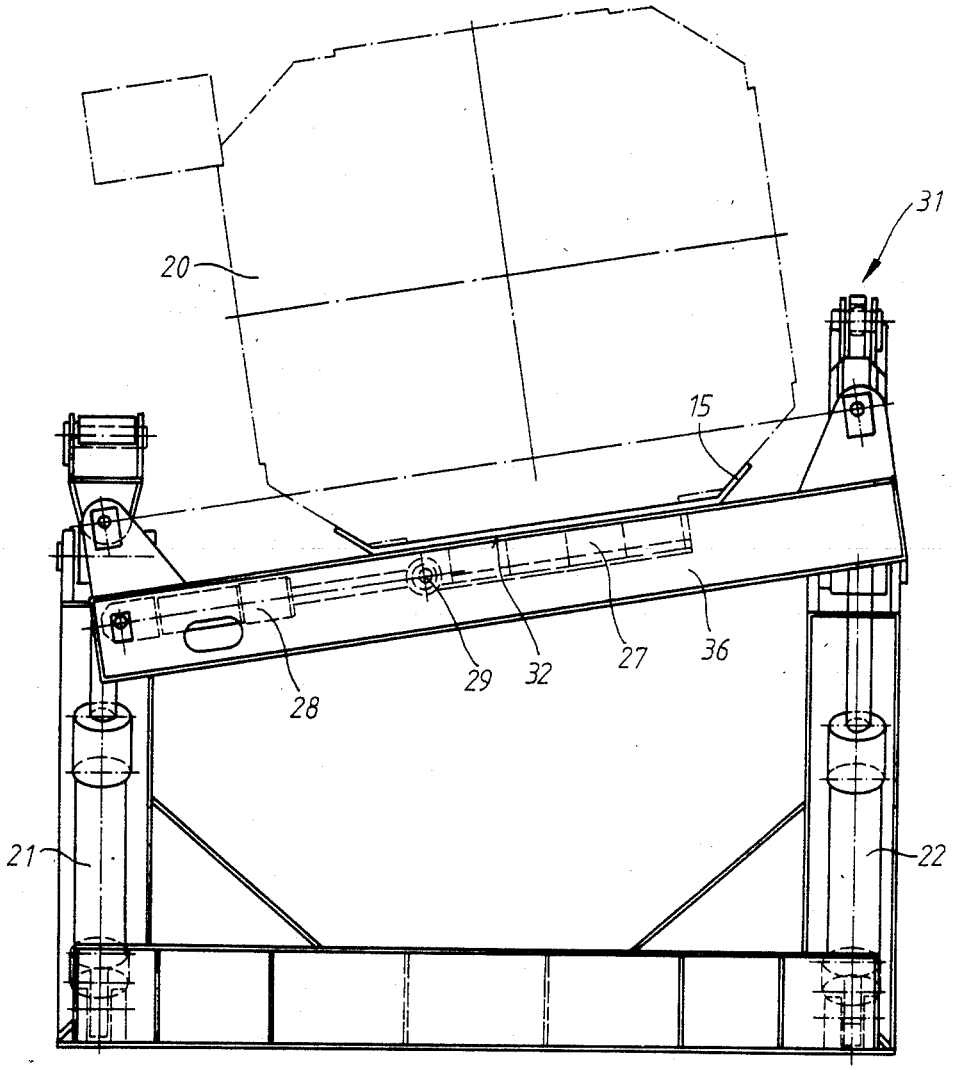
FIG. 5 is a front view of the rear lift provision.

FIG. 5 shows a possible inclined position of the crane jib 20 produced by way of coordinated control of left and right hydraulic cylinders 21 and 22.

Another support table 15 is mounted on the rear cross-frame 36 and is shiftable via slide plates 27, 32. The support table 15 is adjustable by way of the hydraulic cylinder 28 in the direction of the longitudinal axis of the cross-frame 36. The piston rod of the hydraulic cylinder 28 engages the support table 15 via a bolt 29.

I claim:

1. A hydraulic lifting assembly for direct mounting of a crane jib from a flat bed transport vehicle on which the crane jib is carried, the longitudinal axis of the crane jib and the bed of the transport vehicle both extending substantially horizontally in a direction from the front to the rear of said vehicle, said assembly comprising a front and a rear lifting provision on the bed of said transport vehicle spaced from each other in said longitudinal direction, each of said lifting provisions comprising:

left and right vertical base frames supported on the bed of said transport vehicle and spaced from each other transversely to said longitudinal axis;

left and right lift arms, one end of each lift arm being pivotally attached to the upper end of the corresponding base frame;

a rigid cross-frame;

means for pivotally coupling the opposite ends of said cross-frame to the free ends of said left and right lift arms, respectively, thereby pivotally coupling the free ends of said lift arms to each other; and left and right hydraulically controlled lifting devices respectively connected between the corresponding base frames and lift arms and adapted to elevate the free ends of said lift arms to independently controllable elevations; and at least one of said lifting provisions further comprising a support table mounted on the cross-frame thereof for supporting the end of said crane jib at the corresponding end of said transport vehicle;

whereby said crane jib may be controllably tilted and elevated with respect to said transport vehicle and pivoted with respect to said longitudinal axis.

2. A hydraulic lifting assembly in accordance with claim 1, wherein said support table is slidable on the cross-frame on which it is mounted in a direction transverse to said longitudinal direction.

3. A hydraulic lifting assembly in accordance with claim 1 or 2, wherein said means for pivotally coupling said cross-frames to said lift arms comprises, for each of said lifting provisions, a left and a right pendulum arm, one end of each such pendulum arm being connected to the free end of the corresponding lift arm and the other end of each such pendulum arm being hingedly attached to the end of the cross-frame which is coupled to such lift arm.

4. A hydraulic lifting assembly in accordance with claim 3, wherein the hinged attachment of each of said pendulum arms to each of said cross-frames comprises a parallelogram suspension.

5. A hydraulic lifting assembly according to 1 or 2, characterized in that said luffing support table is tiltably supported on a luffing support bolt extending in said longitudinal direction and which is supported by a luffing support block mounted on the cross-frame of said one lifting provision, thereby facilitating pivoting of said crane jib around said longitudinal axis.

6. A lifting mechanism according to claim 5, characterized in that the luffing support block is mounted on the cross-frame of said one lifting provision by slide plates, whereby said support block is slidable on said cross-frame transversely to said longitudinal direction.

7. A hydraulic lifting assembly according to claim 5, characterized in that said luffing support table is mounted on the cross-frame of the front lifting provision.

8. A hydraulic lifting assembly according to claim 1, characterized in that the crane jib engages a centering nose in a coordinated recess at the front end of said transport vehicle.

* * * * *